US005816205A

United States Patent [19]

Moriya

[11] Patent Number: 5,816,205

[45] Date of Patent: Oct. 6, 1998

[54] OIL SUPPLY STRUCTURE IN VARIABLE VALVE TIMING MECHANISM

[75] Inventor: Yoshihito Moriya, Nagoya, Japan

[73] Assignee: Toyota Jidosha Kabushiki Kaisha, Toyota, Japan

[21] Appl. No.: 899,311

[22] Filed: Jul. 23, 1997

[30] Foreign Application Priority Data

Jul. 25, 1996 [JP] Japan ..... 8-196091

[51] Int. Cl.[6] ..... F01L 1/344; F02D 13/02

[52] U.S. Cl. ..... 123/90.17; 123/90.31; 123/90.34

[58] Field of Search ..... 123/90.12, 90.15, 123/90.17, 90.31, 90.33, 90.34, 182.1

[56] References Cited

U.S. PATENT DOCUMENTS

| | | | |
|---|---|---|---|
| 5,058,539 | 10/1991 | Saito et al. | 123/90.17 |
| 5,203,290 | 4/1993 | Tsuruta et al. | 123/90.17 |
| 5,377,639 | 1/1995 | Nakadouzono et al. | 123/90.17 |
| 5,566,651 | 10/1996 | Strauss et al. | 123/90.17 |
| 5,657,671 | 8/1997 | Morii | 123/90.17 |
| 5,666,914 | 9/1997 | Ushida et al. | 123/90.17 |

FOREIGN PATENT DOCUMENTS

| | | |
|---|---|---|
| 0 643 201 | 3/1995 | European Pat. Off. . |
| 93/24736 | 12/1993 | Germany . |
| 6-159020 | 6/1994 | Japan . |
| 7317511 | 12/1995 | Japan . |
| 814015 | 1/1996 | Japan . |
| 828219 | 1/1996 | Japan . |

*Primary Examiner*—Weilun Lo
*Attorney, Agent, or Firm*—Kenyon & Kenyon

[57] ABSTRACT

An oil supply structure for a variable valve timing mechanism that adjusts the valve timing of an exhaust valve of an engine. A exhaust side camshaft having a journal is provide for actuating the exhaust valve. A cylinder head and a bearing cap rotatably support the camshaft at its journal. A pulley is mounted on the distal end of the camshaft, and the pulley is rotatable relative to the camshaft. A belt connects the pulley to the crankshaft to transmit power from the engine to the pulley. The belt applies a force to the pulley and the camshaft. A ring gear is provided for changing the relative rotational relationship between the camshaft and the pulley. First and second chambers are defined for applying a hydraulic fluid pressure to the ring gear. First and second passages are defined in the camshaft, and the first and the second passages are connected to the first and second chambers, respectively. First and second conduits are formed in the cylinder head, and the first and second conduits are connected to the first and second passages, respectively. An oil pressure is supplied to the second chamber via the second conduit and the second passage to advance the valve timing of the exhaust valve with respect to the crankshaft. The second conduit and the second passage are connected at a position closer to the pulley than where the first conduit and the first passage are connected.

11 Claims, 4 Drawing Sheets

OIL SUPPLY STRUCTURE IN VARIABLE VALVE TIMING MECHANISM

BACKGROUND OF THE INVENTION

The present invention relates to an oil supplying structure incorporated in a variable valve timing mechanism, which changes the valve timing of an intake valve or an exhaust valve of an engine.

A conventional variable valve timing mechanism varies the valve timing of this intake valves or the exhaust valves of an engine. Japanese Unexamined Patent Publication No. 7-317511 discloses such variable valve timing mechanism that changes the valve timing of the exhaust valves of an engine.

In a typical variable valve timing mechanism, the exhaust camshaft is provided with a journal and the exhaust camshaft is rotatably supported on the cylinder head of the engine by the journal and a bearing. The exhaust camshaft is also joined to a pulley. The pulley is coupled to the crankshaft of the engine by a timing bolt. The rotation of the crankshaft is transferred to the pulley through the timing belt.

A ring gear is provided between the camshaft and the pulley for coupling the camshaft with the pulley. The coupling allows the camshaft to rotate integrally with the pulley. The ring gear is moved along the axis of the camshaft by hydraulic force or the force of a spring. Moving the ring gear along the axis of the exhaust camshaft causes the pulley to rotate respective to the camshaft. This advances or retards the rotational phase of the camshaft with respect to the crankshaft. The valve timing of the exhaust valve is advanced or retarded, accordingly.

A first chamber and a pressure chamber are defined on both sides of the ring gear, respectively. The first chamber is provided with pressure for retarding the valve timing of the exhaust valve, while the second chamber is provided with pressure for advancing the valve timing of the exhaust valve. The second chamber may also be provided with a spring. The spring urges the ring gear toward the first pressure chamber, or in a direction advancing the valve timing of the exhaust valve.

In either case, the exhaust camshaft has a first oil passage, which is communicated with the first chamber, and a second oil passages, which is communicated with the second chamber, formed therein. The first passage has a first opening in the periphery of the journal and the second passage has a second opening in the periphery of the journal. The bearing is provided with first and second conduits corresponding to the first and second openings, respectively. Further, an oil pump for supplying oil to the first and second conduits is coupled to the crankshaft.

The oil pump is driven by rotation of the crankshaft and supplies oil to the first and second conduits. Supplying oil to the second chamber through the second conduit and the second passage moves the ring gear toward the first chamber. The movement of the ring gear advances the rotational phase of the exhaust camshaft relative to the crankshaft. The valve timing of the exhaust valve is advanced, accordingly. Part of the oil flowing from the second conduit to the second passage enters between the journal of the exhaust camshaft and the bearing and lubricates the journal and the bearing.

Supplying oil to the first pressure chamber through the first conduit and the first passage, on the other hand, moves the ring gear toward the second pressure chamber. The movement of the ring gear retards the rotational phase of the exhaust camshaft relative to the crankshaft. The valve timing of the exhaust valve is retarded, accordingly. Part of the oil flowing from the first conduit to the first passage enters between the journal of the exhaust camshaft and the bearing and lubricates the journal and the bearing. This structure requires no oil passages for lubricating the journal and the bearing other than the first and second conduits and passages.

When the engine is idling, the ring gear is moved toward the first pressure chamber by oil pressure supplied to the second chamber and by the force of the spring provided in the second chamber. This displaces the rotational phase of the exhaust camshaft to the most advanced position relative to the crankshaft. The valve timing of the exhaust valve is most advanced, accordingly. This minimized the valve overlap of the intake valve and the exhaust valve. As a result, the combustion of air-fuel mixture in the combustion chamber in the engine is stabilized. Since the ring gear is moved by the resultant force of the oil pressure and the spring in the second chamber, the oil pressure communicated with the second chamber can be relatively small. This allows the size of the oil pump for sending oil to the second chamber to be reduced. Even if the oil pressure supplied to the second pressure chamber is lowered, the resultant force retains the ring gear at the position closest to the first pressure chamber.

However, when rotation of the crankshaft is transferred to the exhaust camshaft by the timing belt and the pulley, the tension of the belt pulls the exhaust camshaft through the pulley toward the crankshaft. In other words, a load toward the crankshaft is applied to the exhaust camshaft. The load is received by the bearing. The pulley is located closer to the distal end of the camshaft than the bearing. Therefore, the contact pressure between the journal and bearing is greater at a location close to the pulley. This degrades the lubricity between the journal and the bearing in the location close to the pulley. As a result, the journal and the bearing are more worn on one side.

When the engine is idling, the rotational speed of the crankshaft is low. This causes the pump to discharge less oil. The pressure communicated with the second chamber is decreased, accordingly. Further, the pressure of the oil drained from the first chamber is lower than the pressure of oil supplied to the first chamber. Thus, less oil is supplied between the journal and the bearing if a conduit to which oil is drained is located at the poorly lubricated part of the journal and the bearing.

SUMMARY OF THE INVENTION

Accordingly, it is an objective of the present invention to improve the lubricity between the journal and the bearing in a variable valve timing mechanism.

To achieve the above objective, the present invention provides an oil supply structure for a mechanism that adjusts the valve timing of a valve of an engine. The structure includes a crankshaft, a camshaft for actuating said valve, the camshaft having a distal end and a journal, a bearing for rotatably supporting said camshaft at its journal. A rotor is mounted near the distal end or the camshaft, and the rotor is rotatable relative to the camshaft. A transmission means is provided for connecting said rotor to the crankshaft to transmit power from the engine to the rotor, wherein the transmission means applies a force to the rotor and the camshaft. An actuator is provided for changing the relative rotational relationship between said camshaft and said rotor. A first pressure chamber for applying a hydraulic fluid pressure to said actuator to move said actuator in a first direction. A second pressure chamber for applying a hydraulic fluid pressure to said actuator to move said actuator in a second direction. A first passage defined in said camshaft, the first passage being connected to said first pressure chamber. A second passage defined in said camshaft, the second passage being connected to said second pressure chamber. A first conduit formed in the bearing, the first conduit being connected to said first passage at a first location, wherein oil is supplied to the first pressure chamber via the first conduit and the first passage to retard the valve timing of the valve with respect to the crankshaft. A second conduit formed in the bearing, the second conduit being connected to said second passage at a second location, wherein oil is supplied to the second pressure chamber via the second conduit and the second passage to advance the valve timing of the valve with respect to the crankshaft. The second location is closer to the rotor than the first location.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

An oil supply structure for a variable valve timing mechanism (hereafter referred to a VVT) according to the present invention will now be described with reference to FIGS. 1 to 4.

Figure 4:
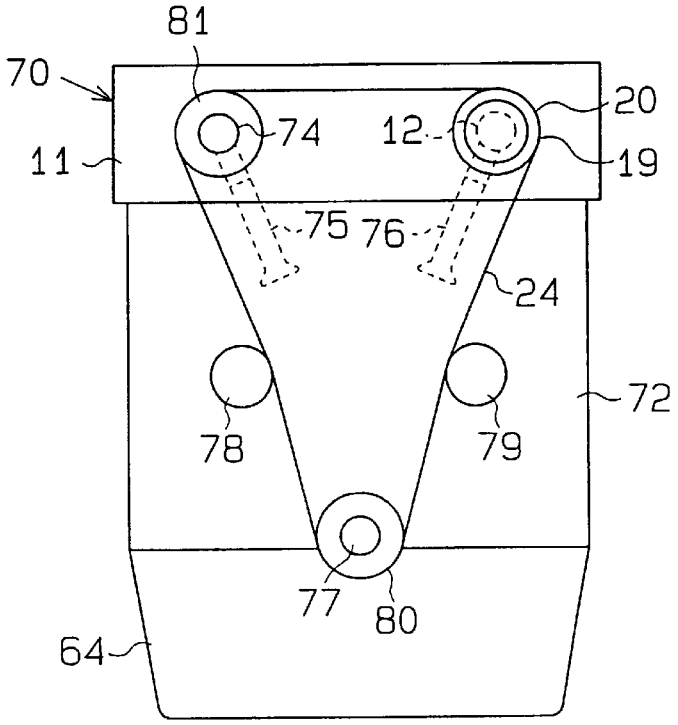
FIG. 4 is a diagrammatic front view showing an engine provided with the variable valve timing mechanism.

An engine 70 having a valve train that includes a VVT 19 is shown in FIG. 4. The engine 70 includes an oil pan 64 for reserving lubricating oil, a cylinder block 72 provided with cylinders (not shown), and a cylinder head 11. The cylinder head 11 supports camshafts 74, 12, exhaust valves 76, and intake valves 75.

The cylinder block 72 rotatably supports a crankshaft 77. Tensioners 78, 79 are arranged at predetermined positions on the cylinder block 72. The cylinder head 11 rotatably supports the camshaft 12 so as to open and close the exhaust valves 76. The cylinder head 11 also rotatably supports the camshaft 74 so as to open and close the intake valves 75. The VVT 19 is provided at 8 distal end of the camshaft 12. Pulleys 80, 81, 20 are provided at distal ends of the crankshaft 77, the camshaft 74, and the VVT 19, respectively. A belt 24 is wound about the pulleys 80, 81, 20. Tension is applied to the wound belt 24 by the tensioners 79, 79. The tension is directed to pull the pulleys 80, 81, 20 toward one another. This prevents the belt 24 from falling off the pulleys 80, 81, 20. The tension also prevents the belt 24 from sliding with respect to the pulleys 90, 81, 20.

The rotation of the crankshaft 77 is transmitted to the camshafts 12, 74 by means of the belt 24 and the pulleys 80, 81, 20. This rotates the camshafts 12, 74 synchronously with the crankshaft 77. The rotation of the camshafts 12, 74 selectively opens and closes the associated exhaust and intake valves 76, 75 in accordance with a predetermined timing.

Figure 1:
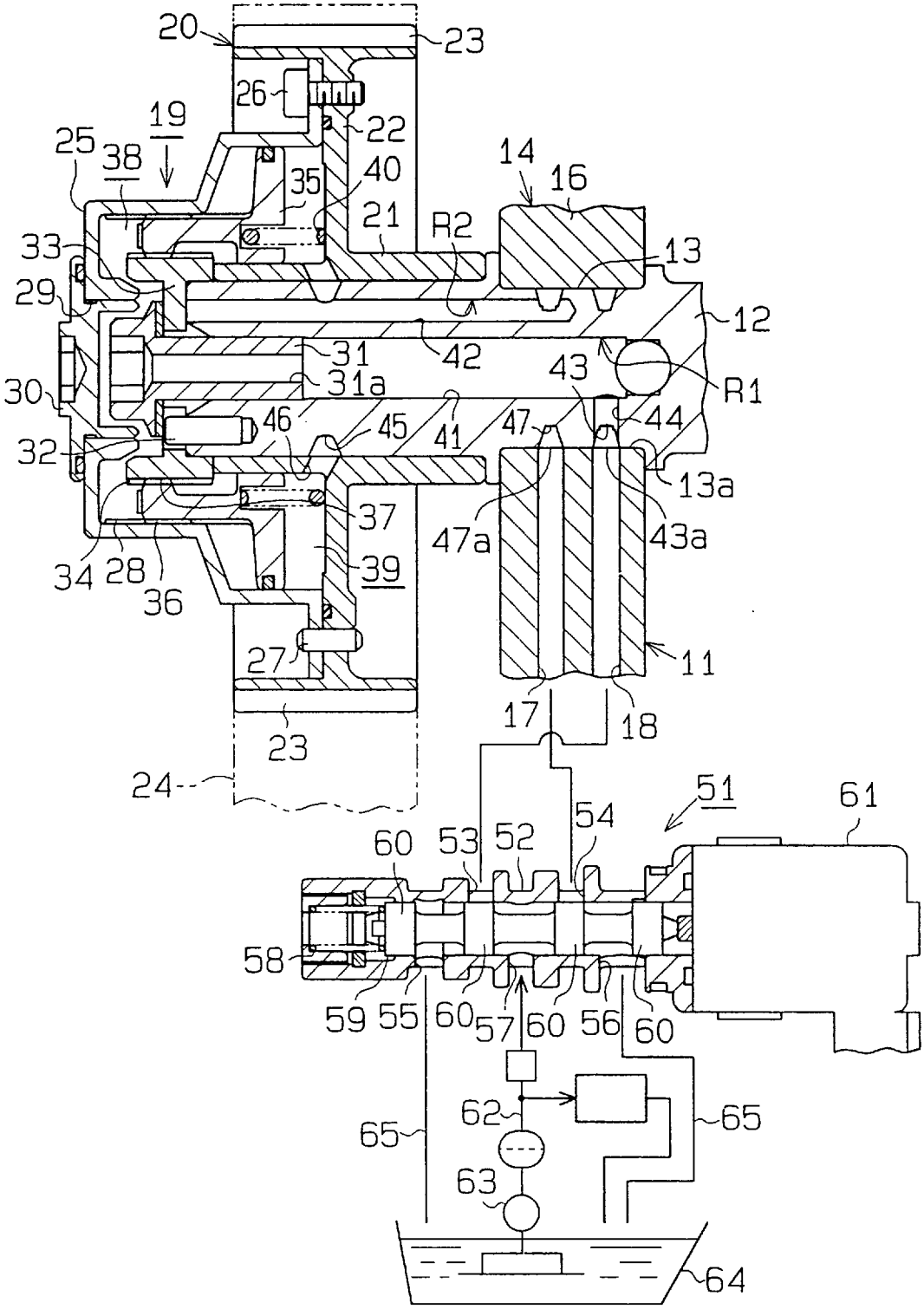
FIG. 1 is a cross-sectional view showing an oil supply structure for a variable valve timing mechanism according to the present invention.
Figure 2:
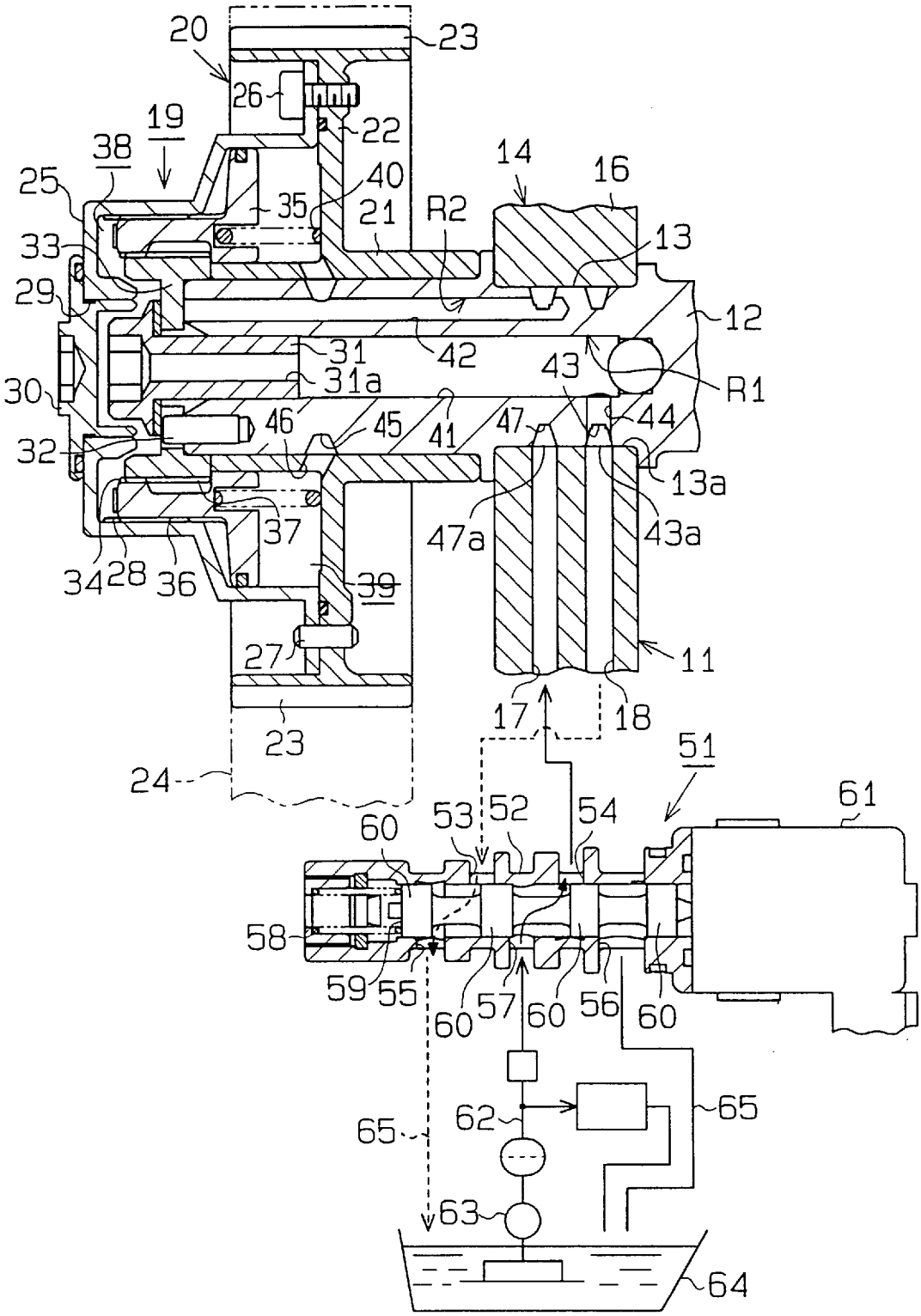
FIG. 2 is a cross-sectional view showing the oil supply structure of FIG. 1 when the ring gear is at the leftmost position.
Figure 3:
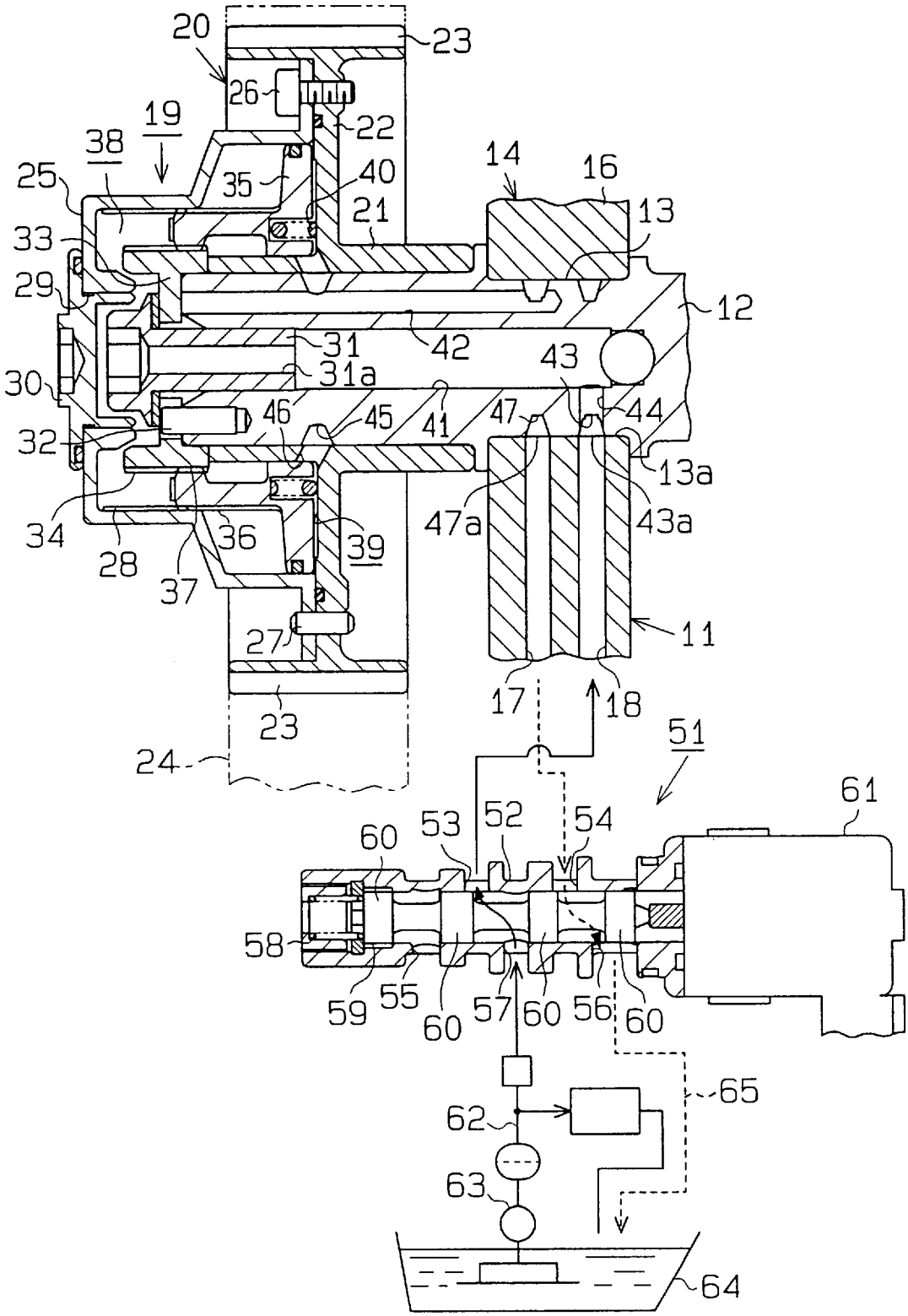
FIG. 3 is a cross-sectional view showing the oil supply structure of FIG. 1 when the ring gear is at the rightmost position.

FIGS. 1 to 3 shows the VVT 19 that includes the pulley 20 serving as a rotor, a cover 25 fastened to the pulley 20, and a ring gear 35 located between the cover 25 and the exhaust side camshaft 12. The exhaust side camshaft 12 is simply hereafter referred to a camshaft 12.

The camshaft 12 has a journal 13 that is rotatably supported between the cylinder head 11 and a bearing cap 16. The cylinder head 11 encompasses the lower half of the journal 13 while the bearing cap 16 encompasses the upper half of the journal 13. The cylinder head 11 and the bearing cap 16 forms a journal bearing 14. A first oil conduit 18 and a second oil conduit 17 are formed in the cylinder head 11.

The pulley 20, which has a substantially disc-like shape, is fitted to the camshaft 12 in a manner allowing relative rotation with respect to the camshaft 12. The pulley 20 includes a boss 21 defined at the center, a disk portion 22 extending radially and a plurality of outer teeth 23. The outer teeth 23 projects from its peripheral surface. The outer teeth 23 of the pulley 20 mesh with the belt 24.

The cover 25 has a cup-like shape. A plurality of bolts 26 and pins 27 fasten the cover 25 to the pulley 20. The cover 25 has a plurality of inner teeth 28 and an opening 29. The opening 29 is closed by a removable lid 30.

A cylindrical inner gear 33 is fastened to the distal end of the camshaft 12 by a hollow bolt 31 and a pin 32. The inner gear 33 and the pulley 20 are rotatable with respect to each other. A plurality of outer tooth 34 project from the inner gear 33. The inner teeth 29 of the cover 25 and the outer teeth 34 of the inner gear 33 are helical splines that are engaged with each other.

The ring gear 35 is arranged between the inner gear 33 and the cover 25. Thus, the ring gear 35 connects the inner gear 33 to the cover 25. Inner teeth 37 project from the inner circumferential surface of the ring gear 35 while outer teeth 36 project from the outer circumferential surface of the ring gear 35. The teeth 36, 37 are helical splines. The inner teeth 37 are meshed with the outer teeth 34 of the inner gear 33, while the outer teeth 36 are meshed with the inner teeth 28 of the cover 25. The ring gear 35 is movable in the axial direction of the camshaft 12.

As described above, when the rotation of the crankshaft 77 is transmitted to pulley 20, the pulley 20 and the exhaust side camshaft 12 are rotated synchronously with the crankshaft 77. The rotation of the camshafts 12 selectively opens and closes the associated exhaust and valves 76 in accordance with a predetermined timing.

Tension applied to the belt 24 constantly pulls the pulley 20 and the camshaft 12 toward the crankshaft 77. The tension causes the camshaft 12 to receive load that is oriented in a generally downward direction. This presses the journal 13 against the cylinder head 11.

When moved axially toward the left, the helical splines rotate the ring gear 35 relatively to the camshaft 12 and the cover 25 (pulley 20). Thus, the valve timing of the exhaust valve 76 is advanced with the rotational phase of the crankshaft 77. When moved axially toward the right, the helical splines rotate the ring gear 35 relatively to the camshaft 12 and the cover 25 (pulley 20). Thus, the valve timing of the exhaust valve 76 is delayed with the rotational phase of the crankshaft 77.

In the cover 25, a first chamber 38 is defined on one side of the ring gear 35 while a second chamber 39 is defined on the other side of the ring gear 35. A spring 40 is positioned in the second chamber 39 to urge the ring gear 35 toward the first chamber 38.

A first oil passage 41 is provided in the camshaft 12 to communicate hydraulic pressure to the first chamber 38. The first oil passage 41 extends in the axial direction of the camshaft 12. The distal end of the first oil passage 41 is connected to the first chamber 39 through the hollow 31*a* of the bolt 31. The basal end of the first oil passage 41 is connected to the first oil groove 43 by way of a first oil hole 44, which extends radially through the camshaft 12. The hollow 31*a,* the first oil passage 41, the oil hole 44, and the first oil groove 43 constitute an passage R1 for retarding the valve timing of the exhaust valve 76.

A second oil passage 42, which extends parallel to the first oil passage 41, is provided in the camshaft 12 to communicate hydraulic pressure to the second chamber 39. The basal end of the second oil passage 42 is connected to the second oil groove 47. The distal end of the second oil passage 42 is connected to a third oil groove 45. A third oil hole 46 defined in the boss 21 connects the second chamber 39 with the third oil groove 45. The third oil hole 46, the third oil groove 45, the second oil passage 42, and the second oil groove 47 constitute an passage R2 for advancing the valve timing of the exhaust valve 76.

The second oil groove 47 opens at an opening 47*a,* which is formed on the periphery 13*a* of the journal 13 and is located near the pulley 20. The opening 47*a* is communicated with the second oil conduit 17, which is formed in the cylinder head 11. The first oil groove 43 opens at an opening 43*a,* which is formed on the periphery 13*a* of the journal 13 and is located further from the pulley 20 than the groove 47. The opening 43*a* is communicated with the first oil conduit 18 formed in the cylinder head 11.

The pressures of oil in the chambers 38, 39 are adjusted by duty controlling an oil control valve (OCV) 51. The OCV 51 includes a casing 52, a spool 59 housed in the casing 52, a spring 58 for urging the spool 59 and an electromagnetic solenoid 61. The casing 52 has first to fifth ports 53, 54, 55, 56, 57. The first port 53 is connected to the first oil conduit 18 and the second port 54 is connected to the second oil conduit 17. The third and fourth ports 55, 56 are connected to the oil pan 64 via an drain passages 65, respectively, and the fifth port 57 is connected to the oil pump 63 via a supply passage 62. The oil pump 63 is connected to the crankshaft 77, and the pump 63 is driven by the rotation of the crankshaft 77. The pump 63 supplies oil to the OCV 51 via the supply passage 62.

A passage including a relief valve (both not shown) connects a part of the supply passage 62 located at the downstream side of the oil pump 63 with the drain passage 65. The relief valve drains the oil in the passage 62 when the pressure in the passage 62 is excessively high.

The spool 59 has four cylindrical valve bodies 60. The spool 59 reciprocates along its axis. The solenoid 61, which is attached to the casing 52, moves the spool 59 between the a first position (shown in FIG. 2) and a second position (shown in FIG. 3).

As shown FIG. 2, the first position refers to a position of the spool 59 when it is rightmost with respect to the casing 52. The spool 59 has the minimum stroke at the first position. As shown FIG. 3, the second position refers to a position of the spool 59 when it is leftmost with respect to the casing 52. The spool 59 has the maximum stroke at the second position. The spring 58 in the casing 52 urges the spool 59 toward the first position.

When in the first position as in rig. 2, the spool 59 communicates the fourth port 56 with the second port 54 and communicates the first port 53 with the third port 55. When the spool 59 is moved to the second position against the force of the spring 58 as shown in FIG. 3, the spool 59 communicates the fourth port 56 with the first port 53 and communicates the second port 54 with the fifth port 57. When the spool 59 is located at the midpoint between the first and second positions, the first and second ports 53, 54 are closed.

When the spool 59 is moved to the first position as in FIG. 2, oil from the pump 63 is supplied to the second chamber 39 through the supply passage 62, the OCV 51, the second oil conduit 17 and the passage R1, increasing the pressure in the second chamber 39, while oil in the first chamber 38 is drained through the passages R1, the first oil conduit 18, the OCV 51 and the drain passage 65. The increase of the pressure in the second chamber 39 moves the ring gear 35 leftward (in FIG. 2) against the oil in the first chamber 38. This rotates the ring gear 35 with respect to the cover 25 and the pulley 20. The rotational phase of the gear 35 is advanced with respect to the pulley 20. As a result, the valve timing of the exhaust valve 76 is advanced with respect to the rotational phase of the crankshaft 77.

Advancing the valve timing of the exhaust valve 76 decreases the valve overlap of the exhaust valve 76 and the intake valve 75. This stabilizes the fuel combustion when the engine 70 is idling. During the engine idling, the rotation speed of the crankshaft 77 is very low. Accordingly, the amount of oil displaced by the pump 63, which is driven by the crankshaft 77, is decreased. This lowers the pressure of oil supplied to the VVT 19 through the second oil conduit 17 and the passage R2, and the pressure of oil drained through the passage R1 and the first oil conduit 18. Even if the oil pressure supplied to the second chamber 39 is lowered, the force of the spring 40 retains the ring gear 35 at the leftmost position as viewed in FIG. 2. The valve timing of the exhaust valve 76 is thus retained at the most advanced position. When the engine 70 is idling, the pressure of oil supplied to the VVT 19 Is higher than the pressure of oil drained therefrom. The pressure of the oil drained from the VVT 19 is reduced substantially to zero.

Then tension of tho belt 24 pulls the camshaft 12 toward the crankshaft 77 thereby bending the camshaft 12. This increases the contact pressure between the cylinder head 11 and the journal 13 at a location close to the pulley 20. Contacting parts of the journal 13 and the bearing 14 need to be lubricated. Especially, the part close to the pulley 20 needs to be sufficiently lubricated because of the increased contact pressure.

The pressure of the oil flowing from the second oil conduit 17 to the passage R2 is higher than the pressure of the oil flowing in the passage R1 and the first oil conduit 18, and the second oil groove 47 is located at the side close to the pulley 20. Therefore, a portion of the oil flowing through the second oil conduit 17 and the passage R2 is supplied between the journal 13 and the cylinder 11 at the part close to the pulley 20 and lubricates the part.

When the spool 59 is moved to the second position against the force of the spring 58 as shown in FIG. 3, the spool 59 communicates the fourth port 56 with the first port 53 and communicates the second port 54 with the fifth port 57. Therefore, oil from the pump 63 is supplied to the first chamber 38 through the supply passage 62, the OCV S1, the first oil conduit 18 and the passages R1, increasing the pressure in the first chamber 38, while oil in the second chamber 39 is drained through the passages R2, the second oil conduit 17, the OCV 51 and the drain passage 65. The increase of the pressure in the first chamber 38 moves the ring gear 35 rightward (in FIG. 3) against the oil in the second chamber 39. This rotates the ring gear 35 with respect to the cover 25 and the pulley 20. The rotational phase of the gear 35 is retard with respect to the pulley 20. As a result, the valve timing of the exhaust valve 76 is retard with respect to the rotational phase of the crankshaft 77.

When the engine load is relatively great, the valve timing of the exhaust valve 76 is generally retarded for increasing the valve overlap of the exhaust valve 76 and the intake valve 75. In this state, the rotational speed of the crankshaft 77 is relatively high and causes the pump 63 to generate sufficiently high hydraulic pressure. This increases the pressure of oil supplied to the VVT 19 through the second oil conduit 17 and the passage R2 and the pressure of oil drained through the passage R1 and the first oil conduit 18. Increasing the pressure of the oil supplied to the VVT 19 and the pressure of the oil drained therefrom results in sufficient oil being supplied between the journal 13 and the cylinder head 11 for lubrication.

The preferred embodiment described above improves the lubrication between the journal 13 and the cylinder 11 thereby preventing seizure between the journal 13 and the cylinder head 11. The preferred embodiment also prevents the journal 13 and the cylinder head 11 from being worn on one side.

If the pressure supplied to the second chamber 39 is small, the force of the spring 40 retains the ring gear 35 at the leftmost position. This allows the size of the pump 63 to be reduced. Even in this case, the preferred embodiment ensures lubrication between the journal 13 and the cylinder head 11.

Although only one embodiment of the present invention has been described so far, it should be apparent to those skilled in the art that the present invention may be embodied in many other specific forms without departing from the spirit or scope of the invention. Particularly, it should be understood that the invention may be embodied in the following forms.

The first and second oil grooves 43, 47, which are formed on the periphery 13*a* of the journal 13, may be omitted. In this case, a couple of oil grooves are formed on the inner wall of the bearing 14.

Instead of the drive force of the crankshaft 77, the pump 63 may be driven by other drive sources such as an electrical motor. In this case, the displacement of the pump 63 is maintained constant regardless of the rotational speed of the crankshaft 77.

The spring 40 may be omitted. This simplifies the structure of the VVT. Each of the pulleys 20, 8O, 81 may be replaced with sprockets and the belt 24 may be replaced with a chain.

Figure 5:
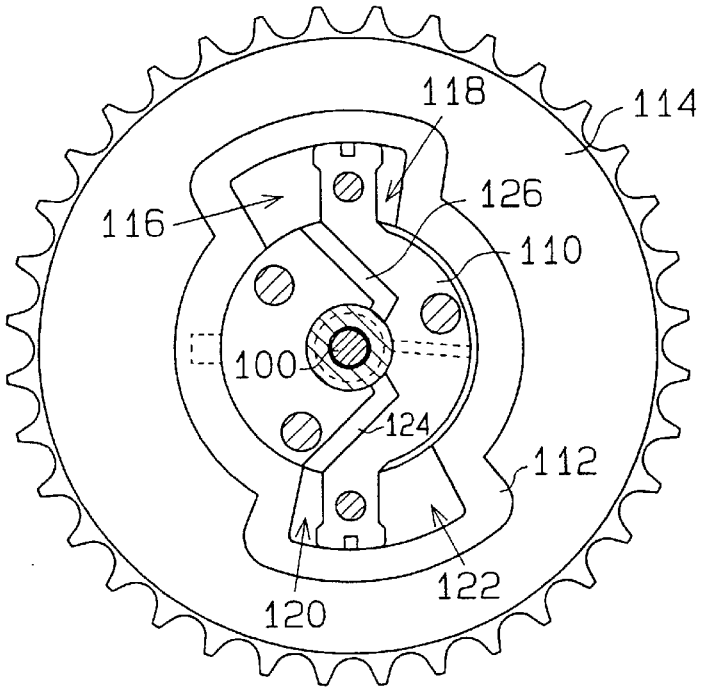
FIG. 5 is a partial enlarged cross-sectional view showing a second embodiment of a variable valve timing mechanism according to the present invention.

The present invention may be embodied in engines provided with other types of VVTs. While there are various possible types of VVTs, the present invention can be applied to any desired type of VVT so long as it can substantially change the rotational phase between the camshaft and a rotor. For example, a vane type VVT as shown in FIG. 5 may be employed. A vane type VVT like that shown in FIG. 5 is described in detail in U.S. Pat. No. 5,107,804, which is incorporated herein by reference. The vane type VVT, which is fixed to the end of the camshaft 100, has a vaned rotor 110, a housing 112 surrounding the rotor and a sprocket 114.

The sprocket 114 and the housing 112 are integral and are rotatable with respect to the camshaft 100 and the rotor 110. Further, this VVT has chambers 116–122 on each side of the vanes, the chamber 116–122 being formed by cooperation between the vanes on the rotor 110 and the housing 112. The sprocket 114 is connected to the crankshaft with a timing chain (not shown). By selectively applying hydraulic pressure to the chamber 116, 120 through passages 124, 126, the camshaft 100 can be rotated clockwise or counter clockwise with respect to the sprocket 114. Therefore, it functions like the VVT of the first embodiment.

Therefore, the present examples and embodiments are to be considered as illustrative and not restrictive and the is invention is not to be limited to the details given herein, but may be modified within the scope and equivalence of the appended claims.

What is claimed is:

1. An oil supply structure for a mechanism that adjusts the valve timing of an exhaust valve of an engine, the structure comprising:

a crankshaft;

a camshaft for actuating said exhaust valve, the camshaft having a distal end and a journal;

a bearing for rotatably supporting said camshaft at its journal;

a rotor mounted near the distal end of the camshaft, the rotor being rotatable relative to the camshaft;

a transmission means for connecting said rotor to the crankshaft to transmit power from the engine to the rotor, wherein the transmission means applies a force to the rotor and the camshaft;

an actuator for changing the relative rotational relationship between said camshaft and said rotor, wherein an initial position of said actuator is set to an advancing position to advance the valve timing of said exhaust valve when the engine is started;

a first pressure chamber for applying a hydraulic fluid pressure to said actuator to move said actuator in a first direction;

a second pressure chamber for applying a hydraulic fluid pressure to said actuator to move said actuator in a second direction;

a first passage defined in said camshaft, the first passage being connected to said first pressure chamber;

a second passage defined in said camshaft, the second passage being connected to said second pressure chamber;

a first conduit formed in the bearing, the first conduit being connected to said first passage at a first location, wherein oil is supplied to the first pressure chamber via the first conduit and the first passage to retard the valve timing of the exhaust valve with respect to the crankshaft, and a second conduit formed in the bearing, the second conduit being connected to said second passage at a second location, wherein oil is supplied to the second pressure chamber via the second conduit and the second passage to advance the valve timing of the valve with respect to the crankshaft, and wherein a distance between the second location and the rotor is smaller than a distance between the first location and the rotor.

2. The structure according to claim 1, further comprising a pump driven by the rotation of the crankshaft for selectively supplying the oil pressure to the first pressure chamber and the second pressure chamber, wherein oil from the pump is supplied to the second pressure chamber when the rotational speed of the crankshaft is relatively low.

3. The structure according to claim 2, further comprising an urging means positioned in the second pressure chamber for urging the actuator in the second direction.

4. The structure according to claim 2, further comprising a hydraulic control unit for controlling the flow of fluid supplied to the first and second chambers.

5. The structure according to claim 2, wherein the first passage includes a first groove formed on the journal, and the second passage includes a second groove formed on the journal.

6. The structure according to claim 2, wherein the direction of the force applied to the camshaft is along a line intersecting said camshaft and said crankshaft.

7. The structure according to claim 2, wherein said actuator includes a ring gear, and wherein said first and second pressure chambers are positioned respectively at opposite sides of the ring gear.

8. The structure to claim 7, further comprising:

outer teeth fixed to the camshaft;

inner teeth fixed to the rotor;

outer teeth fixed to the ring gear, wherein said outer teeth on the ring gear engage the inner teeth fixed to the rotor thus forming an outer coupling;

inner teeth fixed to the ring gear, wherein said inner teeth fixed to the ring gear engage the outer teeth fixed to the camshaft thus forming an inner coupling; and a helical spline coupling formed by at least one of the outer coupling and the inner coupling.

9. The structure according to claim 2, wherein said rotor includes a pulley, and wherein said transmission means includes a belt.

10. The structure according to claim 2, wherein said actuator includes a vane, and wherein said first and second pressure chambers are located on opposite sides of the vane, respectively.

11. An apparatus for adjusting the valve timing of an exhaust valve of an engine, the apparatus comprising:

a crankshaft;

a camshaft for actuating said exhaust valve, the camshaft having a distal end and a journal;

a bearing for rotatably supporting said camshaft at its journal;

a rotor mounted on the distal end of the camshaft, the rotor being rotatable relative to the camshaft;

a transmission means for connecting said rotor to the crankshaft to transmit power from the engine to the rotor, wherein the transmission means applies a force to the rotor and the camshaft;

an actuator for changing the relative rotational relationship between said camshaft and said rotor, wherein an initial position of said actuator is set to an advancing position to advance the valve timing of said exhaust valve when the engine is started;

a first pressure chamber for applying a hydraulic fluid pressure to said actuator to move said actuator in a first direction;

a second pressure chamber for applying a hydraulic fluid pressure to said actuator to move said actuator in a second direction;

a pump driven by the rotation of the crankshaft for selectively supplying an oil pressure to the first pressure chamber and the second pressure chamber;

a first passage defined in said camshaft, the first passage being connected to said first pressure chamber;

a second passage defined in said camshaft, the second passage being connected to said second pressure chamber;

a first conduit formed in the bearing, the first conduit being connected to said first passage at a first location; and a second conduit formed in the bearing, the second conduit being connected to said second passage at a second location;

wherein oil is supplied to the second pressure chamber via the second conduit and the second passage when the rotational speed of the crankshaft is relatively low, and wherein a distance between the second location and the rotor is smaller than a distance between the first location and the rotor.

* * * * *

UNITED STATES PATENT AND TRADEMARK OFFICE

CERTIFICATE OF CORRECTION

PATENT NO. : 5,816,205
DATED : October 6, 1998
INVENTOR(S) : Yoshihito Moriya

It is certified that error appears in the above-identified patent and that said Letters Patent is hereby corrected as shown below:

Title page,
Item [57], ABSTRACT,
Line 3, change "A exhaust" to -- An exhaust -- change "provide" to -- provided --.

Column 1,
Line 30, change "respective" to -- relative --.

Column 2,
Line 15, change "minimized" to -- minimizes --.
Line 59, change "or" to -- of --.
Line 66, after "chamber" insert -- is provided --.

Column 3,
Line 1, after "chamber" insert -- is provided --.
Lines 3 and 5, after "passage" insert -- is --.
Line 7, after "conduit" insert -- is --.
Line 12, before "formed" insert -- is --.
Line 48, change "a VVT" to -- as VVT --.
Line 63, change "8" to -- a --.

Column 4,
Line 12, change "shows" to -- show --.
Line 16, change "a" to -- as --.
Line 30, change "projects from its" to -- project from their --.
Line 57, change "camshafts 12" to -- camshafts 12, 74 --.
Line 66, change "relatively" to -- relative --.

Column 5,
Line 3, change "relatively" to -- relative --.
Line 16, change "39" to -- 38 --.
Lines 21 and 32, change "an passage" to -- a passage --.
Line 52, change "an drain passages" to -- a drain passage --.

UNITED STATES PATENT AND TRADEMARK OFFICE

CERTIFICATE OF CORRECTION

PATENT NO. : 5,816,205
DATED : October 6, 1998
INVENTOR(S) : Yoshihito Moriya

It is certified that error appears in the above-identified patent and that said Letters Patent is hereby corrected as shown below:

Column 6,
Line 52, change "tho" to -- the --.

Column 7,
Line 6, change "S1," to -- 51, --.
Lines 15 and 16, change "retard" to -- retarded --.
Line 61, change "8O," to -- 80, --.

Column 8,
Lines 11 and 15, change "chamber" to -- chambers --.
Line 20, after "the" delete "is".

Signed and Sealed this

Sixteenth Day of July, 2002

*Attest:*

*Attesting Officer*

JAMES E. ROGAN
*Director of the United States Patent and Trademark Office*